United States Patent [19]

Sutton

[11] Patent Number: 4,780,916

[45] Date of Patent: Nov. 1, 1988

[54] TUB SEAT MASSAGER

[76] Inventor: Bernard S. Sutton, 128 Lafayette Ave., Brooklyn, N.Y. 11238

[21] Appl. No.: 47,490

[22] Filed: May 11, 1987

[51] Int. Cl.[4] ..... A61H 33/02

[52] U.S. Cl. ..... 4/543; 4/559; 4/574; 4/575; 4/578; 128/66

[58] Field of Search ..... 4/541-543, 4/559, 573, 574, 575, 578, 579, 567, 568, 615; 128/66

[56] References Cited

U.S. PATENT DOCUMENTS

| | | | |
|---|---|---|---|
| 2,649,861 | 8/1953 | Melsheimer | 4/559 |
| 2,663,178 | 12/1953 | Schwartz | 4/559 |
| 3,240,208 | 3/1966 | Everston | 4/559 |
| 3,367,325 | 2/1968 | O'Keefe | 4/559 |
| 3,467,969 | 9/1969 | Szekely | 4/543 |
| 4,216,552 | 8/1980 | Gurolnick | 4/572 |
| 4,546,505 | 10/1985 | Wakenshaw | 4/542 |
| 4,574,406 | 3/1986 | Sutton et al. | 4/559 |

*Primary Examiner*—Henry J. Recla
*Assistant Examiner*—Linda J. Sholl

[57] ABSTRACT

Tub seat massager for immersion into a bath tub including a contoured stiff frame including a back on which is mounted a top portion also contoured to provide comfort when a person is resting thereon. The sealed space between the top portion and the back is provided with plural air tight sections which connect to indented openings in the top portion. There is also included an air distribution device which will direct pressurized air to the air tight sections so that the pressurized air will flow out the openings to massage and soothe the person resting in the tub.

5 Claims, 4 Drawing Sheets

TUB SEAT MASSAGER

BACKGROUND OF THE INVENTION

The present invention relates generally to contoured bath tub seat supports which are constructed to permit the flow of pressurized air through the interior of the seat to massage all parts of a person's body while being comfortably supported by the contoured seat.

Contour seats have been provided in the prior art that are made to support a person while bathing, for example: the instant inventor has fashioned such a seat in U.S. Pat. No. 4,574,406. Other examples of such seats are shown in U.S. Pat. Nos. 2,582,439 and 3,605,208.

Also there are products available which are submerged in a tub to massage a person while seated therein. One such item is sold by Regina Home Spa and comprises a flat cushioned pad which is hinged so as to take the form of the tub in which it is immersed. However as can be imagined the flat pad in no way can be considered to provide a contoured shape as is intended herein. A pressurized air supply causes air to flow through the pad into the water to cause bubbles and turbulence. Other tub massagers simply flow pressurized air directly into the water to cause bubbles and turbulence. While these systems provide a massaging effect the present invention is an improvement over and an extension of such systems.

SUMMARY OF THE INVENTION

In the inventive system a contoured tub seat massager is formed to comfortably support the head, neck, back, arms, buttocks and legs of a person. Reference is also made to disclosure document for the invention, No. 162306 filed Jan. 20, 1987.

The tub seat massager comprises a stiff contoured bottom and preferably a stiff top generally taking the same shape as the bottom. An internal air-tight portion is formed by joining - in airtight relation the top and bottom as will be described below. Additionally, the internal air-tight portion is also sub-divided into air-tight sections each of which interconnects with an air distribution device which in turn is connected to a source of pressurized air.

Also there are indented openings, formed in the top of the tub seat massager, which may, if desired, be constructed of foam, all interconnected internally to each of the air tight sections so that air will flow from said pressurized air source through said air distribution device selectively into said air tight section to the sub-divisions thereof out the indented openings to massage a person resting on said tub seat massager when immersed in a water filled tub.

Accordingly, one object of this invention is to provide a tub seat massager which when in use will support a person comfortably to provide a massaging and soothing effect on the head, neck, back, arms, buttocks and legs.

Among other objects of this invention are to provide a tub seat massager of the character stated which comprises few and simple parts that are assembled readily, which provide a relative light weight carrying capacity, which to a great extent is capable of being furnished prefabricated or readily assembled, which is cheap to manufacture, which is capable of being fabricated in quantity production, and which is practical and economical to a high degree in use.

The foregoing and other objects, features and advantages will appear more fully from the accompanying drawing in conjunction with a detailed description of a preferred embodiment.

DESCRIPTION OF THE PREFERRED EMBODIMENT

Figure 1:
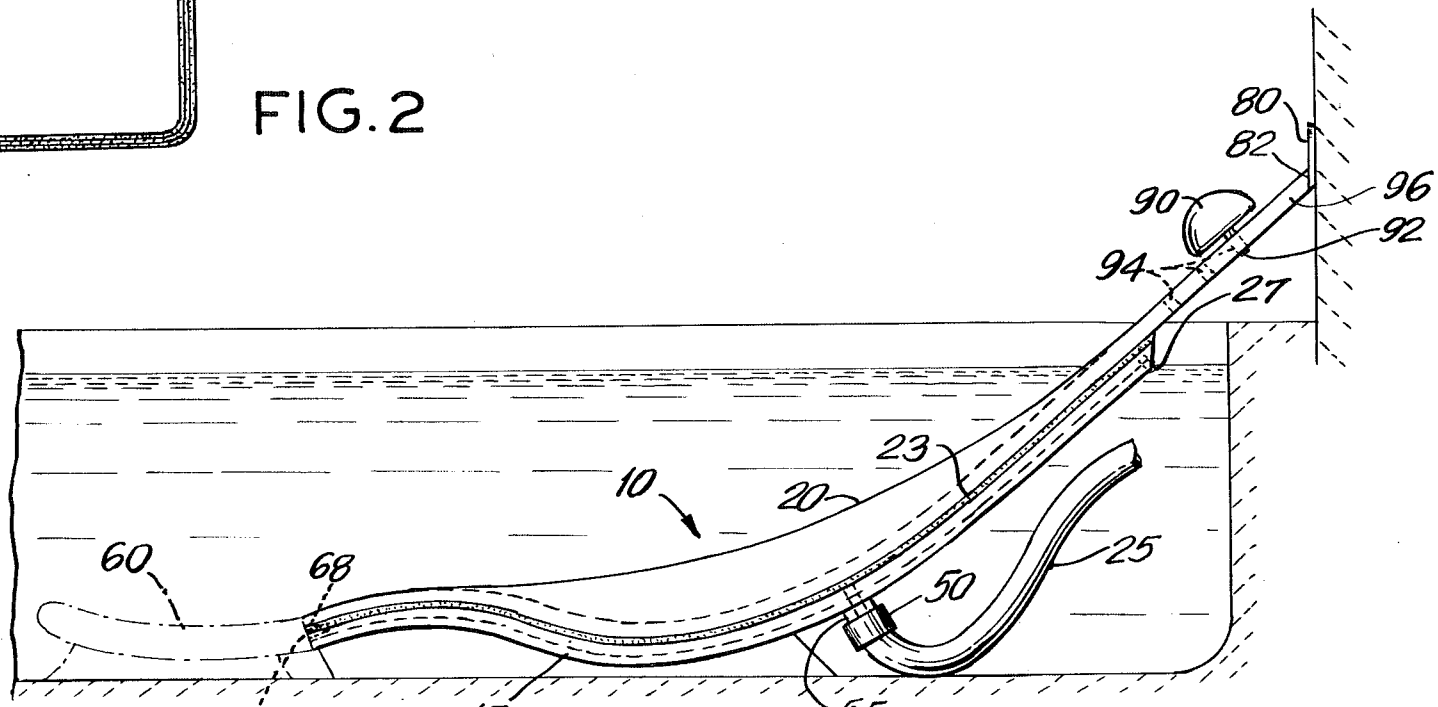
FIG. 1 is a side view (partly in cross section) of the invention in a bath tub which is also a side view and partly in cross section.
Figure 2:
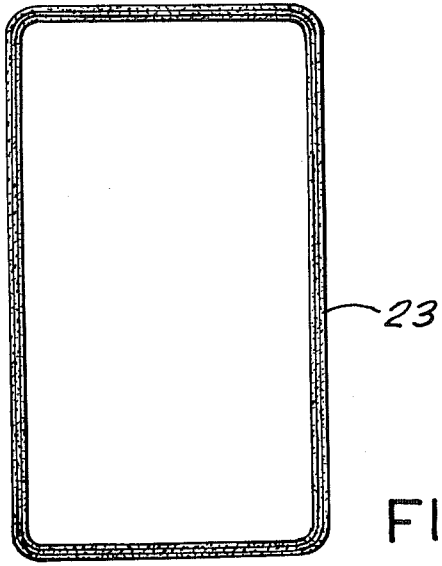
FIG. 2 is a top view of the seal for providing air tight sections.
Figure 3:
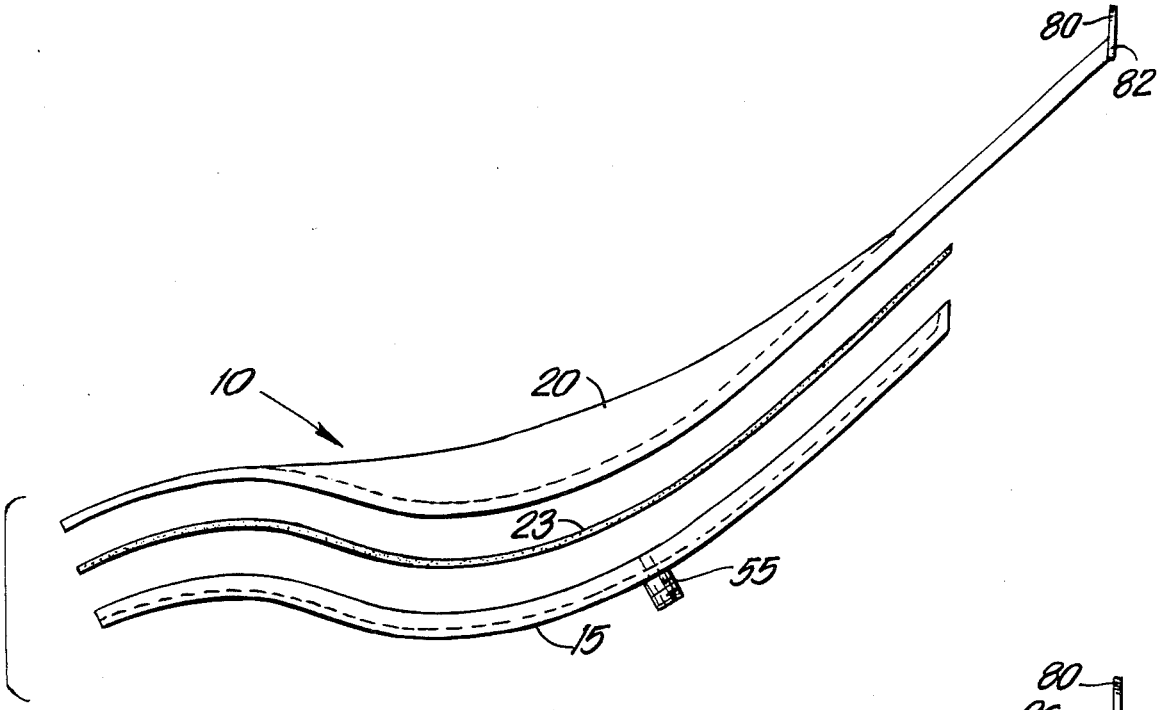
FIG. 3 is a side view of the invention showing the top, bottom or back and seal in exploded position.

Turning to the drawing in which similar reference characters denote similar elements through the several views, FIGS. 1 through 3 illustrate the tub seat massager, generally designated 10, having a contoured base or bottom 15 preferably made of stiff material such as molded plastic. At the top portion there is provided a stiff or plastic portion 20 which is also contoured and preferably of same shape as the contoured bottom 15.

Figure 3A:
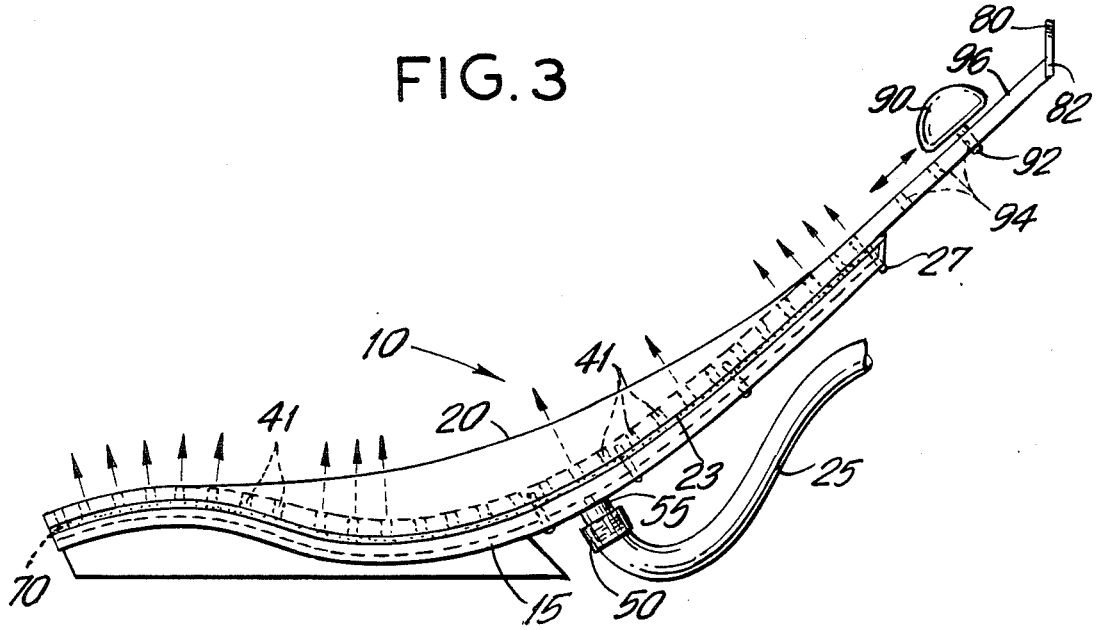
FIG. 3A is a view like FIG. 3 showing the parts assembled.
Figure 8:
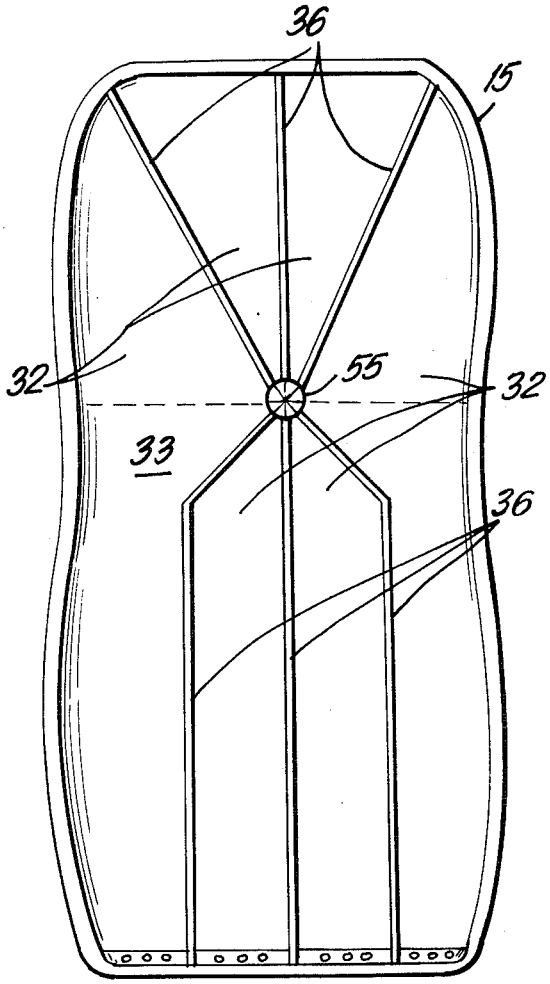
FIG. 8 is a top view of the tub massager with the contoured top of FIG. 7 removed and showing the distribution valve schematically and the air-tight sections.

Air tight sections 32, best shown in FIG. 8, are formed between the top and bottom portions or units 20 and 15 of FIG. 2. The seal 23 consists of a rubber or plastic element which takes the form or shape of the outer edges of the top and bottom portions 20 and 15. It may be connected at the edges such as by gluing or by the use of rivets or screws shown at 27 in FIG. 3A which screws would connect the seal around its periphery in sandwiched relation between the contour top and bottom of the tub seat massager.

Dividers 36 shown in FIG. 8 are to provide air tight sections 32 in the interior 33 of the tub seat massager. These air tight sections are formed between the top 10 and bottom 15 in the tub seat.

Figure 10:
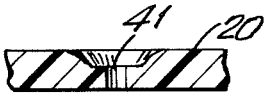
FIG. 10 is a section on line 10—10 through an opening in FIG. 7.

Also openings 41 are molded into the top portion 20 of the tub seat massager and are preferably indented as shown in FIG. 10. In this fashion localized bubbling and turbulence is formed in a preselected pattern so as to provide a more complete massaging for the head, neck, arms, shoulders, back, buttocks and legs.

A supply of pressurizing air (not shown) is connected through hose 25 to the tub seat massager as shown in FIG. 1. There may be included a connection 50 as a molded part at the bottom 15 or other separate connecter arrangements may be utilized.

There is also disposed in the bottom or base 15 a distribution valve 55 which communicates or connects with each of the air tight sections 32 through a number of preselected flow channels 57 whereby pressurized air flows into connector 50 through distribution valve 55 into each of the channels 57 which direct the flow into sections 32 out the openings 40 into the tub to massage a person resting in the tub seat massager.

Further to provide an air tight section the dividers 36 are in air tight abutment with the top portion 20 of the tub-seat: This may be accomplished by glueing or any other known manner of attachment.

Figure 4:
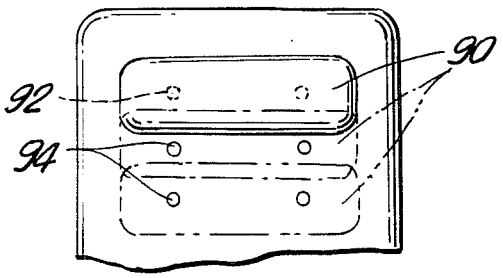
FIG. 4 is a partial front view of the top of the tub seat showing the head rest with provision for adjusting same.
Figure 5:
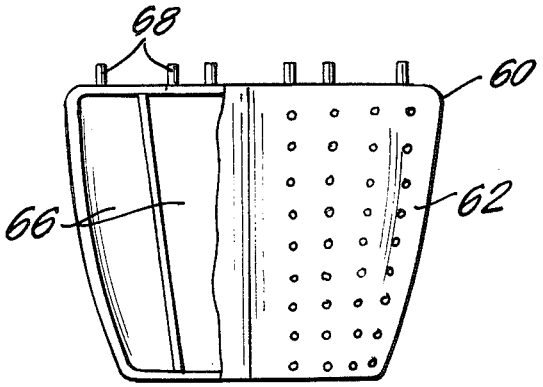
FIG. 5 is a partial front view of the bottom of the unit showing a foot and lower leg rest.

In FIG. 5 there is shown an auxiliary member 60 which serves as a leg and foot support and may be connected to the bottom portion of the contoured tub massager. It includes a top 62 having openings and air tight sections 66 two of which are shown and connecting means 68 which mount into complementary connectors 70 shown in FIG. 4 in air tight relation. This can be achieved by any well known mode. The lower leg and foot unit 60 may be used as desired.

Figure 6:
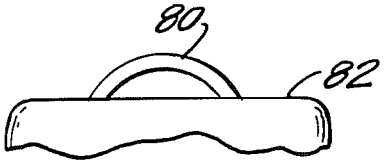
FIG. 6 is a partial front view of a hook which facilitates hanging the unit for draining.
Figure 9:
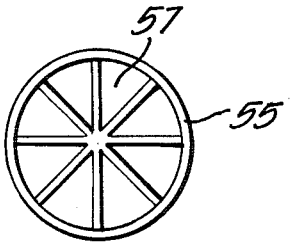
FIG. 9 is an enlarged view of the distributing valve which flows air selectively to the air-tight sections.

In FIG. 6 there is shown a hook 80 mounted at the top of the unit as at 82 and functions to hold the unit upright for drainage or drying.

Figure 7:
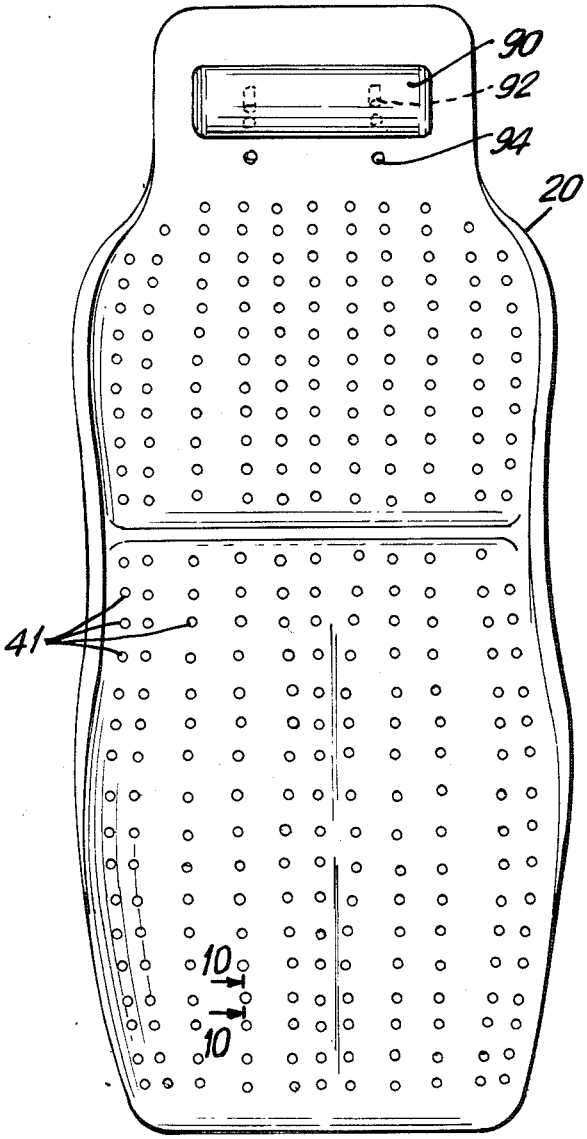
FIG. 7 is a top view of the tub massager showing the openings for air flow into the tub.

In FIG. 7 there is shown a pillow type of headrest 90 which at the bottom includes connectors 92 which are mounted into openings or connectors 94 formed in the contoured tub seat.

In this way an improved tub seat massager is fashioned and while certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A tub seat massager comprising a stiff contoured-shaped seat capable of supporting a person desiring a massage, including a back and detachable leg portion to provide comfort and support to the head, neck, back, arms, buttocks and legs of a person, said tub seat massager including a contoured top portion of stiff material and bottom portion of stiff material having the same contour as said top portion, said tub seat massager also including plural airtight sections internally and formed between said top and bottom portions, a seal mounted around the periphery of and sandwiched between said top and bottom portions to maintain said airtight sections airtight, and openings being disposed on the surface of said top portion, and certain of said openings communicating with certain of said plural airtight sections, a means for supplying pressurized air to each of said plural airtight sections, in a pre-selected manner, a distribution means mounted centrally on the bottom of tub seat massager interconnecting the means for suppyling pressurized air to the plural airtight sections, in a pre-selected manner, whereby a person may rest on said tub seat massager and upon actuation of said means for supplying pressurized air, said pressurized air will flow into said airtight sections through said openings to massage said person.

2. The tub seat massager of claim 1 including an adjustable headrest moveably mounted so as to form a head support and a hook means mounted near said head support to permit hanging of said tub seat massager to facilitate drying of said tub seat massager.

3. The tub seat massager of claim 1 including a detachable leg and foot support which is detachably mounted in airtight relation to the bottomn of the tub seat massager to provide support to and massage the legs and feet.

4. The tub seat massager of claim 1 wherein said means for supplying pressurized air to each of said airtight sections comprises a distributor valve which includes plural sections each communicating with one airtight section at one end and the supply of pressurized air at the other end whereby said pressurized air is selectively distributed to each of the airtight sections.

5. The tub seat massager of claim 4 including a leg and foot support which is detachably mounted in airtight relation to the bottom of the tub seat massager to provide support to and massage the legs and feet.

* * * * *